United States Patent [19]

Wada et al.

[11] Patent Number: 4,692,662

[45] Date of Patent: Sep. 8, 1987

[54] HIGH CONTRAST DISPLAY DEVICE

[75] Inventors: Masatoshi Wada, Osaka; Tetsuo Sakai, Tokyo, both of Japan

[73] Assignees: Okuno Chemical Industries Co. Ltd.; Nippon Hoso Kyokai, Japan

[21] Appl. No.: 752,542

[22] Filed: Jul. 8, 1985

[30] Foreign Application Priority Data

Jul. 13, 1984 [JP] Japan ..... 59-144112
Oct. 4, 1984 [JP] Japan ..... 59-206979

[51] Int. Cl.[4] ..... H01J 61/35

[52] U.S. Cl. ..... 313/493; 313/113; 313/587

[58] Field of Search ..... 313/493, 489, 512, 111, 313/112, 582, 587, 113, 114; 501/32, 18, 23, 26, 76; 340/757

[56] References Cited

U.S. PATENT DOCUMENTS 3,619,698 11/1971 Caras ..... 313/114 X
4,065,698 12/1977 Owaki et al. ..... 313/489
4,224,553 9/1980 Hellwig ..... 313/112 X

*Primary Examiner*—Palmer C. DeMeo
*Assistant Examiner*—Sandra L. O'Shea
*Attorney, Agent, or Firm*—Parkhurst & Oliff

[57] ABSTRACT

Light-emitting cells of a display device are individually provided with inner walls at least partially covered by white reflectors consisting of glass material containing transparent particles having different refractive index by 5 to 80% by weight, so that extremely high luminous efficiency similar as that of optical integrating sphere can be realized. Also, openings for emitting colored light can be applied with color filters while the front surface other than those openings of the display device is covered with light-absorbing black material, so that the reflectance for incident ambient light can be extremely reduced. According to the multiplexed effect of the above structure, remarkably high display contrast can be readily realized.

19 Claims, 19 Drawing Figures

(X1-X2) Crosssection

HIGH CONTRAST DISPLAY DEVICE

BACKGROUND OF THE INVENTION (1) Field of the Invention

The present invention relates to a display device, particularly to a gas discharge device in which the luminous efficiency is improved and high contrast is sustained by high efficiency of anti-reflection of ambient light.

(2) Description of the Prior Art

In various kinds of conventional gas discharge display devices, cell sheets are usually employed for providing discharge cells therein as exemplified by FIG. 1(*a*). In FIG. 1(*a*), a cell sheet CS sandwiched between a front glass plate FG and a rear glass plate RG is provided with plural spaces which are arranged in a for individually forming discharge cells, inner walls thereof being coated with fluorescent layers Ph, display anodes DA and cathode C being arranged in front and rear thereof respectively. These fluorescent layers are excited by ultraviolet rays emitted from gas discharges generated in those discharge cells, so as to radiate desired visible light.

For the cell sheet in the above structure of the gas discharge display device, mechanically workable ceramics for example Macor have been employed and perforated by etching and the like. Otherwise, black banks B formed by firing multilayer-printed black glass paste as shown in FIG. 1(*b*) are employed for providing the discharge cells.

Among these conventional formations of discharge cells, the former is too expensive to work cell sheets and difficult to form a large scaled display device, as well as to provide miniaturized discharge cells. On the other hand, in a gas discharge display device formed by the latter, the efficiency of reflection of the light emitted from the fluorescent layer Ph toward the front view side upon the light-absorbing black glass paste is too low and hence the luminous efficiency in the front view direction is deteriorated. The removal of black pigments from the black glass paste has been tried, in an attempt to improve the above efficiency of reflection thereon. However, effective improvement of efficiency could not be obtained.

Meanwhile, in order to increase the display contrast in various kinds of display devices including cathode ray tube display devices, gas discharge display devices and low velocity electron beam fluorescent display devices, typically the brightness of display is increased and the reflectance of displaying surface is lowered.

Conventional measures for lowering the reflectance of displaying surface of the display device are as follows.

(i) An absorption type neutral density (ND) filter is employed.

(ii) Rare earth elements, for instance, $Nd_2O_3$, are added to the glass material constituting the displaying surface.

(iii) A suitable pigment is added to the fluorescent material constituting the display element.

(iv) The portions other than the fluorescent layer of the display element are coated with black materials.

(v) Granular pigments are deposited on the front surface of the fluorescent layer, so as to form a filter.

In addition, in the display device as disclosed in Japanese Patent Application Laid-open Publication No. 59-36,280, which was filed by the present applicant, as shown in FIGS. 2(*a*), (*b*), the display contrast is increased substantially 4 to 6 times together with the being lowered only about by 20% on account of the application of optical filters formed of substantially transparent inorganic materials, through which color light emitted from plural kinds of colored display elements combined with each other into a colored picture display device are transferred respectively, upon those colored display elements. However, even though the above remarkable increase of the display contrast has been attained, the quality of displayed color picture cannot be satisfied under high ambient illumination with respect to the contrast thereof.

In this connection, FIG. 2(*a*) is a plan view showing a part of the above disclosed gas discharge display device, meanwhile FIG. 2(*b*) is a cross-sectional view-thereof along the line $X_1$–$X_2$.

SUMMARY OF THE INVENTION

An object of the present invention is to provide a display device in which the luminous efficiency in the front view direction is remarkably improved, so as to facilitate the provision of a large scaled display device as well as to facilitate the formation of minuscule display elements, by regarding each of those display elements as a kind of optical integrating sphere.

For attaining this object of the invention, at least a part of inner wall of each light-emitting display element is coated with reflective white material.

A display device according to the present invention is featured in that a glass material including more than 20% by weight of glass powder containing no black pigment and 5 to 80% by weight of at least one kind of powdered material having a refractive index different from that of the glass powder concerned is coated at least on a part of inner wall of a display element of the display device concerned, so as to provide a white inner reflector therein.

The white inner reflector provided in the display element contributes to effectively transfer the color light emitted inside the display element toward the front view side, so as to increase the luminous efficiency of the display element.

Another object of the present invention is to further increase the contrast of display in the above improved display element, which can be regarded as a kind of optical integrating sphere, by reducing the reflection of incident ambient light thereon.

The display device according to the present invention is further featured in that almost all of the front surface of the display device concerned is covered with absorbing material layers for incident ambient light except for in the vicinity of openings of each display elements, the above mentioned white inner reflectors being arranged at least back to back with these absorbing material layers individually.

BRIEF DESCRIPTION OF THE DRAWINGS

For the better understanding of the invention, reference is made to the accompanying drawings, in which.

Throughout different views of the drawings, FG is a front glass plate, RG is a rear glass plate, DA is a display anode, DAB is a display anode bus, C is a cathode, CB is a cathode bus, Ph is a fluorescent layer, BM is a black lattice, CS is a cell sheet, WB is a white bank, WG is a white glass layer, RC is a red light discharge cell, GC is a green light discharge cell, BC is a blue light discharge cell, RF is a red light filter, GF is a green light filter, BF is a blue light filter, and F is a colored light filter.

DESCRIPTION OF THE PREFERRED EMBODIMENTS

Various preferred embodiments of the display device according to the present invention will be described in detail hereinafter.

Figure 3A:
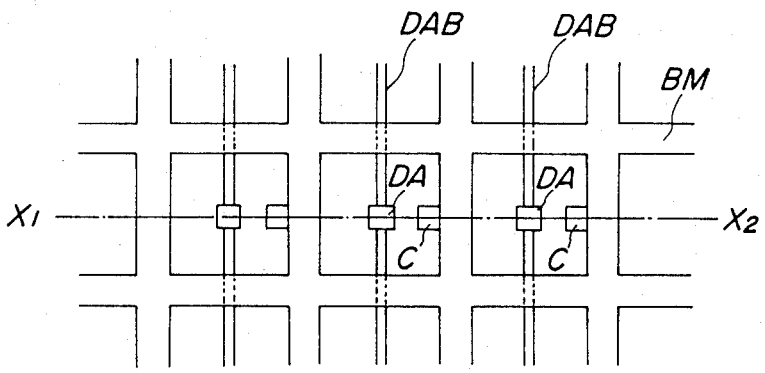
FIGS. 3(*a*) and 3(*b*) are a plan view and a cross-sectional view showing an embodiment of a gas-discharge display device according to the present invention respectively.
Figure 3B:
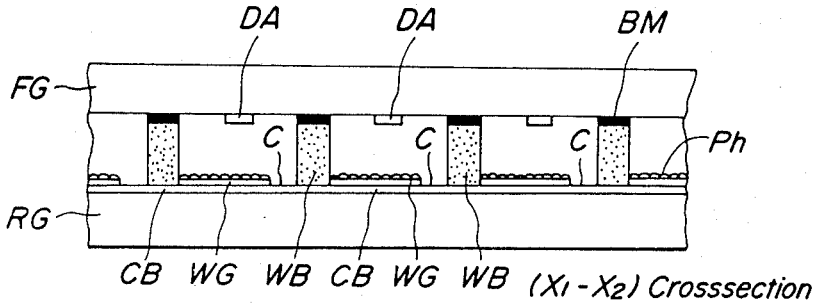

FIGS. 3(*a*) and 3(*b*) show a typical embodiment of a gas-discharge display panel according to the present invention, FIG. 3(*a*) being a plan view thereof, FIG. 3(*b*) being a cross-sectional view thereof along the line $X_1$–$X_2$.

In this embodiment of the gas-discharge display device according to the present invention, a cathode bus CB is printed on a rear glass plate RG and fired, a white glass layer WG consisting of materials described below, is printed thereon except for the vicinity of the cathode C and fired, a fluorescent layer Ph being coated further thereon. On the other hand, a display anode bus DAB is printed on a front glass plate RG and fired, a white bank WB consisting of materials described below, is printed thereon and fired.

For the materials for forming the white glass layer WB and the white bank WB, more than 20% by weight of transparent glass powder having the refractive index $n_0$ and containing no black pigment and 5 to 80% by weight of at least one kind of transparent powdered material having another refractive index $n_1$ which is different from the above refractive index $n_0$, are employed.

Figure 1A:
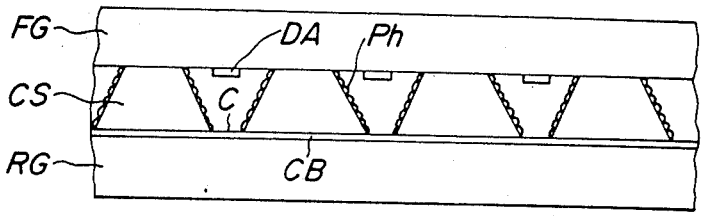
FIG 1a PRIOR ART
FIGS. 1(*a*) and 1(*b*) are cross-sectional views showing conventional gas-discharge display devices respectively as described above.
Figure 1B:
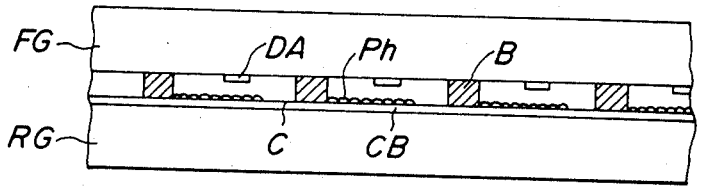
FIG 1b PRIOR ART

According to the above structure of the gas-discharge display device, the ultraviolet ray generated by the gas discharge is converted into the visible light through the fluorescent layer Ph, this visible light being reflected by the white glass layer WG situated behind the fluorescent layer Ph toward the front view side therethrough and then non-directionally dispersed because of the diffusive light. The light components passing through the front glass plate FG are used for effective display, meanwhile the light components striking the wall of the white bank WB is further dispersed. However, if the bank were black as in the conventional gas-discharge display device as shown in FIG. 1(*b*), this further dispersed light is absorbed by the black bank B. On the contrary, in the present invention where the white bank WB has the reflectance in the vicinity of 90%, almost all of the further dispersed light components are transferred toward the front view side.

Figure 4:
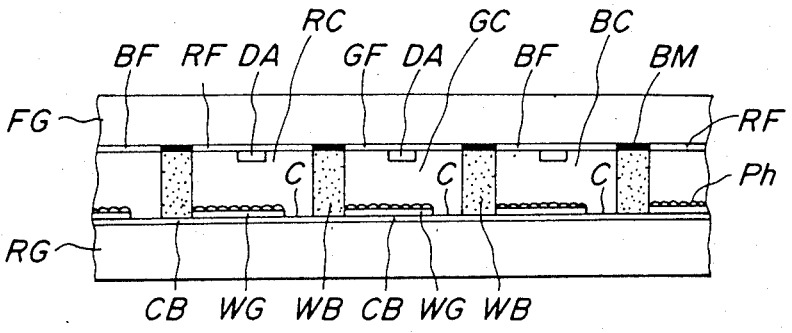
FIGS. 4 to 8 are cross-sectional views showing various embodiments of the gas-discharge display device according to the present invention respectively.

However, in structure of the gas-discharge display device according to the present invention the overall reflectance of the display device for incident ambient light is increased together with that of the individual display element for the emitted light. Thus, it is preferable that the conventional black paste BM is printed on the front top of the white bank WB. Moreover, where optical filters formed of inorganic materials for red, green and blue light, for example, sulfates of copper, alkali metal and alkali earth metal for red, oxides of cobalt with oxides of chrome or with a combination of oxides of chrome and aluminum for green, and oxides of cobalt and aluminum for blue, are arranged in front of red, green and blue discharge cells RC, GC and BC respectively, as shown in FIG. 4, since these optical filters have extremely large ratio of transmittance between respective allotted color light and the other color light, the reflection of the incident ambient light upon the display device is effectively reduced and hence the operational effect of the present invention can be remarkably promoted.

In the single color gas-discharge display, the above optical filter can be provided in front of the front glass plate FG, or the front glass plate FG itself can be provided with the necessary filtering performance. In these situations, any optical filter formed of organic materials can be employed.

In this connection, the materials for forming these white banks or white layers are somewhat porous, so that, the insulation performance of these white banks or white layers can be increased by additionally printing a conventional transparent glass paste on these filter materials, which has been dried or fired, and then firing it, and thereafter any metallic material can be printed thereon.

Figure 5:
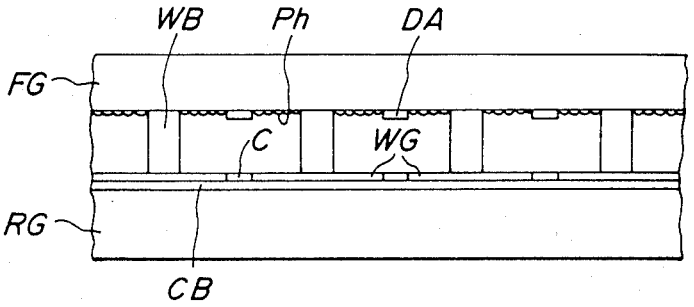

Next, FIG. 5 shows an embodiment of the transmissive view type gas-discharge display device in which the light emitted from the fluorescent layer Ph is viewed through the fluorescent layer Ph concerned. In the conventional display device of this type, the light emitted from the fluorescent layer Ph toward the rear side is absorbed by various portions including the inner wall and the electrodes in the discharge cell, or, is transmitted toward the rear side ineffectively. In contrast therewith, in the embodiment as shown in FIG. 5, almost all of the inner surface of the display element consists of the white bank WB and the white glass layer WG other than the rear side electrode, namely, the cathode C, so that almost all of the light emitted from the fluorescent layer Ph toward the rear side can be efficiently reflected toward the front view side, and, as a result, the luminous output and the luminous efficiency are remarkably increased.

Figure 6:
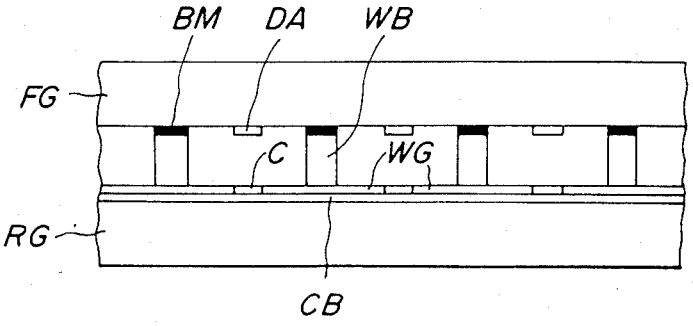

Next, FIG. 6 shows an embodiment of the discharge light direct view type gas-discharge display device filled, for instance, using neon gas. In this embodiment, the visible light components which were conventionally absorbed by the inner surface of the display element can be efficiently reflected toward the front view side as in the embodiment as shown in FIG. 5, because of the increased reflectance of the inner wall surface, so that the luminous efficiency can be increased for the same reasons as mentioned above. In this situation, the aforesaid optical filters are required for selectively reducing the reflection of the incident ambient light.

Figure 7:
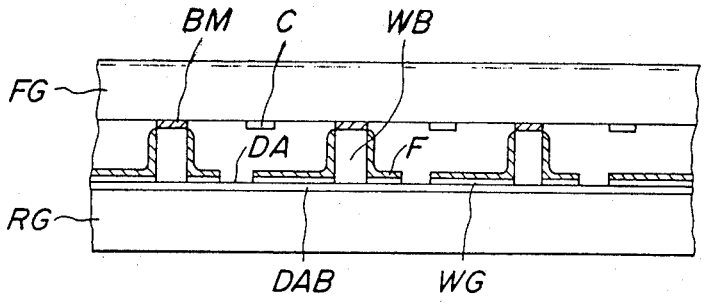

FIG. 7 shows another embodiment of the discharge light direct view type gas-discharge display device, in which the cathode C and the display anode DA are arranged on the front and the rear glass plates FG and RG respectively, opposite to the embodiment as shown in FIG. 6. In this embodiment, materials F for the aforesaid optical filters are coated on the white bank WB and the white glass layer WG forming the inner wall of the display element. Accordingly, the light components emitted in the display element toward the rear side and the inner wall pass through those layers of filter materials F and are reflected on the white reflectors WB and WG, and thereafter transferred toward the front view side through the filter material layers F again. Meanwhile almost all of incident ambient light is absorbed by those filter material layers F.

Figure 8:
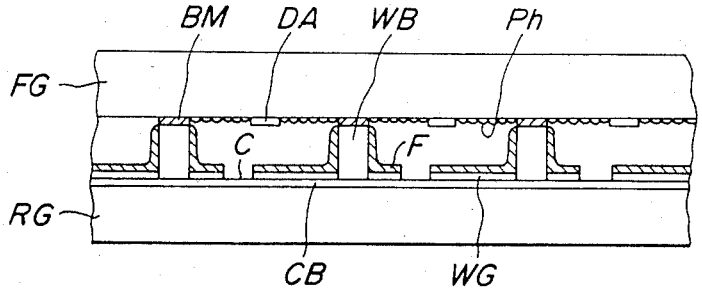

FIG. 8 shows an embodiment constructed substantially the same as that shown in FIG. 7, except that the transparent fluorescent layer Ph is arranged in front of the display element. In this embodiment, the components of the visible light emitted from the fluorescent layer Ph excited by the ultraviolet ray towards the rear side and the inner wall are reflected toward the front view side as described above regarding that as shown in FIG. 7, meanwhile the incident ambient light is similarly absorbed, so that the reflectance thereof is lowered. The fluorescent layers Ph in this embodiment can be formed by depositing, spattering, dipping, ion-implanting and can be the like and employed for multicolor display as well as single color display.

The present invention can be applied to both AC type and DC gas-discharge display devices, particularly to various kinds of facial discharge type display devices among the AC type display devices, and can be applied to both positive column type and negative glow type display device.

The luminous efficiency can also be increased by coating the fluorescent material on the wall of the white bank WB.

Furthermore, the present invention can be applied not only to the gas-discharge display device, but also to the low velocity electron beam display device, in which the components of the light emitted from the fluorescent layer toward the rear side can be reflected toward the front view side by the aforesaid white reflection material deposited on the rear face of the electro-conductive film according to the present invention.

In addition, the present invention can be applied to the gas-discharge display device provided with priming discharge, particularly where the priming discharge is shifted into the display discharge within the same discharge cell, it is efficient to apply the aforesaid white reflection material onto the inner wall of the display discharge section thereof.

Figure 9A:
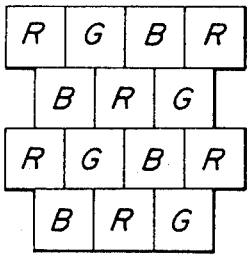
FIGS. 9(*a*) and 9(*b*) are plan views showing various embodiments of a fixed picture display device according to the present invention respectively.
Figure 9B:
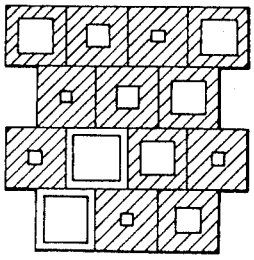

Moreover, in an embodiment of the reflective view type fixed picture display device provided with the piled combination of the respective inorganic optical filters R, G, B for red, green, blue lights as shown in FIG. 9(*a*) and the black masks for half tone display as shown in FIG. 9(*b*), the rear side of the black mask having the opening corresponding to the color to be displayed is covered with the white reflection material according to the present invention and then fired, so as to realize a long life display device. In the situation where the black mask is provided on the rear glass plate, black materials for forming the mask are preferably printed on the white reflection materials printed on the rear glass plate and fired.

Next, the white reflection materials used for the display device according to the present invention will be described in detail hereinafter.

Generally speaking, the light incident onto the interface between the transparent glass material having the refractive index $n_0$ and transparent particles residing therein with the different refractive index $n_1$ ($n_1 \neq n_0$) is totally reflected, refracted or scattered according to the respective laws in response to the refractive index absolute difference $|n_0 - n_1|$ and the density of those particles.

As for the above glass material, any kind of glass material can be employed, as long as it can be glazed onto the glass substrate at the temperature below 700° C., preferably below 600° C.

For example, the glass materials of $PbO$-$SiO_2$-$B_2O_3$ descent, $PbO$-$SiO_2$-$B_2O_3$-$ZnO$ descent, $PbO$-$B_2O_3$-$ZnO$ descent, $Bi_2O_3$-$SiO_2$-$B_2O_3$ descent and of these glass descents containing at least one of $R_2O$(R = Li, Na, K), BaO, CaO, MgO, $TiO_2$, $ZrO_2$, $Al_2O_3$, NaF and $P_2O_5$ are available.

The filling material other than the above transparent glass material, including those particles having the refractive index $n_1$, preferably has heat resistivity in the vicinity of 700° C. and a thermal expansion coefficient similar to that of the glass material particularly in the situation where a large amount is filled therein.

The refractive index $n_0$ of the glass material of PbO descent is about 1.7, so that a filler having a refractive index $n_1 = 1.5$ to 1.9 is required for increase the reflectance thereof. Filler having a refractive index $n_1 = n_0$ may be filled therein by a little amount without expectable efficient result.

The examples of the above filter can be enumerated together with the bracketed refractive index as follows.

Sulfates including sodium sulfate, potassium sulfate, barium sulfate (1.63), zinc sulfate, calcium sulfate, magnesium sulfate and aluminum sulfate.

Phosphates including calcium phosphate, magnesium phosphate, barium phosphate and zinc phosphate.

Oxides including alumina (1.53), silica (1.55), zinc oxide, magnesium oxide, titanium oxide (2.5 to 2.9), zirconium oxide (2.4), calcium oxide, 1st tin oxide, 2nd tin oxide, barium oxide and antimony oxide.

Sulfides including zinc sulfide.

Silicates or minerals containing silica components including talc, cordierite, spodumene, kaoline, calcium silicate, zirconium silicate, zinc silicate, magnesium silicate and aluminum silicate.

Fluorides, which are known to have comparatively low refractive index, including calcium fluoride, magnesium fluoride, barium fluoride and sodium fluoride.

Nitrides including aluminum nitride and boron nitride.

Glass having a glazing temperature higher than 700° C.

Particularly, the reflectance of the glass material can be extremely increased by adding titanium oxide therein by 2 to 20%.

Black materials inhibited to be contained therein by no more than 0.1% are exemplified by iron oxide, chromium oxide, copper oxide, manganese dioxide, nickel oxide and cobalt oxide.

A practically sufficient reflectance can be realized according to the following empirical formuli in the situation where "ai" is the composition rate of the i-th filler.

$$0.01 \leqq \sum_i ai \leqq 0.8$$

$$0.01 \leqq \sum_i |n_o - n_i|\ ai \leqq 1.0$$

1ST EXAMPLE OF WHITE GLASS MATERIAL

A glass material consisting of PbO 63% by weight, $SiO_2$ 15% by weight, $B_2O_3$ 17% by weight and ZnO 5% by weight is melted at 1,000° C. and then pulverized by a ball mill into particles having an average diameter 3 to 5 μm. A mixture powder of the above obtained glass powder 60% by weight together with rutile-type titanium oxide 12% by weight and alumina powder 28% by weight is coated on a glass substrate and fired, so as to obtain the desired white glass material. However, in a situation where the printing thereof is required, the above mixture powder is mixed with an organic vehicle consisting of butyl carbitol 90% by weight, ethyl cellulose 8% by weight and polyvinyl acetatepolybutyral copolymer 2% by weight into the paste, which can be printed on a sodalime glass substrate through a 325 mesh screen.

2ND EXAMPLE OF WHITE GLASS MATERIAL

A mixture powder consisting of powdered glass material having the same composition as that of the above 1st example 80% by weight and rutile-type titanium oxide 20% by weight is employed similarly as the above 1st example being available for the thick coating, meanwhile the 2nd example being available for the rear side coating.

In this connection, the photo-adhesion other than the printing can be employed for coating these white glass materials.

3RD EXAMPLE OF WHITE GLASS MATERIAL

A glass material consisting of PbO 77% by weight, $SiO_2$ 2% by weight, $B_2O_3$ 10% by weight, ZnO 7% by weight, $Na_2O$ 3% by weight and $Al_2O_3$ 1% by weight is melted at 1,000° C. and then pulverized by a ball mill into particles having an average diameter 3 to 5 μm. A mixture powder of the above obtained glass powder 30% by weight together with zinc sulfide 70% by weight is mixed with the same vehicle as that of the 1st example into the paste, which can be printed on a sodalime glass substrate through a 325 mesh stainless screen.

4TH EXAMPLE OF WHITE GLASS MATERIAL

A glass material consisting of $Bi_2O_3$ 73% by weight, $B_2O_3$ 9% by weight, ZnO 8% by weight, $SiO_2$ 6% by weight, $Al_2O_3$ 2% by weight and $Na_2O$ 2% by weight is melted at 1,000° C. and then pulverized by a ball mill into particles having an average diameter 3 to 5 μm. A mixture powder of the above obtained glass powder 82% by weight together with anatase-type titanium oxide 8% by weight and zinc oxide 10% by weight is mixed with the same vehicle as that of the 1st example into the paste, which can be printed on a sodalime glass substrate through a 325 mesh screen.

Figure 10A:
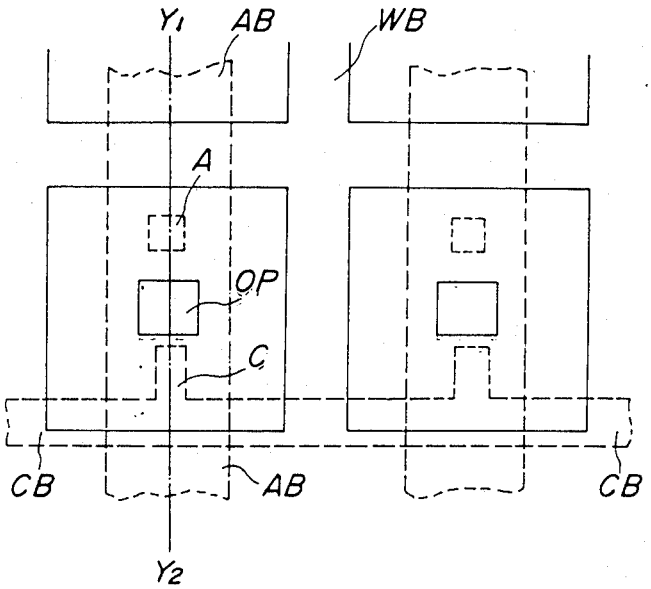
FIGS. 10(*a*) and 10(*b*) are a plan view and a cross-sectional view showing an embodiment of another kind of a gas discharge display device according to the present invention respectively.
Figure 10B:
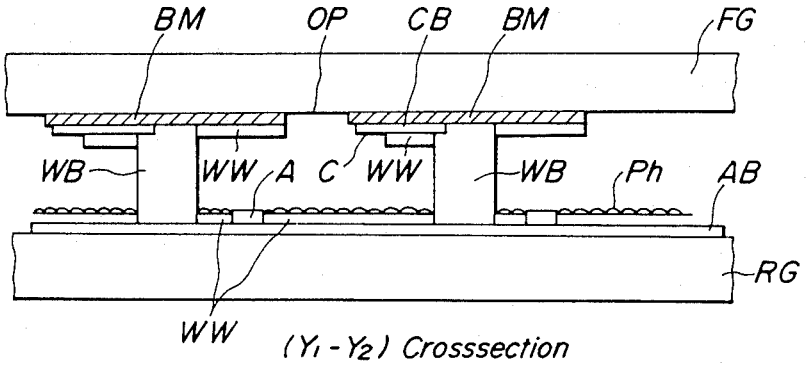

Next, an embodiment of the display device provided for attaining the aforesaid subsidiary object of the present invention will be described in detail hereinafter by referring to the plan view thereof as shown in FIG. 10(*a*) and the cross-sectional view thereof as shown in FIG. 10(*b*). In this embodiment, almost all area of the inner surface of the front glass plate FG is coated with black material layers BM, on which cathode buses CB with cathodes C are arranged. On these cathode buses CB except for the exposed cathodes C, white wall layers WW formed of the aforesaid white glass material is coated, meanwhile the aforesaid white banks WB are stacked on either one of the front and the rear glass plates FG and RG, the anode buses AB with the anodes A being arranged on the inner surfaces of the rear glass plate RG, meanwhile almost all of the inner surface area of the rear glass plate RG is covered with the white wall layers WW except for the exposed anodes A, on which layers the fluorescent layers Ph are coated.

These fluorescent layers Ph are excited by the ultraviolet rays generated through the gas discharge, so as to emit visible light, a part of this light being directly passed through the openings OP toward the front view side, meanwhile the other part of this light being reflected by the inner surfaces of the white banks WB and the white wall layers WW and thereafter passed through the openings OP toward the front view side. In the situation where the reflectance of the white bank WB and the white wall layer WW is sufficiently high, loss of the emitted visible light is very low, so that almost all of the emitted visible light can be transferred toward the front view side by the multiplexed reflection according to the same principle as that of the optical integrating sphere.

On the other hand, the ambient light incident onto the black material layers BM on the front glass plate FG is absorbed thereby, meanwhile almost all of the ambient light passing through the opening OP is substantially reflected according to the above principle, so that, the reflectance for the ambient light is given by the ratio $S_{OP}/(S_{BM}+S_{OP})$ where $S_{BM}$ and $S_{OP}$ are the areas occupied by the black material layer BM and the opening OP respectively, and hence it can be reduced in order of 10% by reducing the area $S_{OP}$ occupied by the opening OP as narrow as possible with a remarkably efficient result in comparison with the conventional reflectance of about 60%.

In this connection, the above ratio $S_{OP}/(S_{MB}+S_{OP})$ can be readily reduced into less than 4% while lowering the luminous output only by 10%.

In the embodiment of the gas-discharge display device as shown in FIGS. 10(*a*), 10(*b*), the position coated with the fluorescent layer Ph is not restricted only to the inner surface of the white wall material layer WW coated on the rear glass plate RG, but also the inner surface of the white wall material layer WW coated on the front glass plate RG can be added thereto. In this connection, the fluorescent layers Ph concerned are available for reflecting the visible light as a kind of white reflector, together with the additionally increased luminous output of the fluorescent layers coated on the front glass plate FG side, which can be directly coated on the inner surface of the front glass plate FG also with a little increased thickness. The luminous efficiency can be further increased by additionally coating the fluorescent layer Ph on the inner wall surface of the white bank WB.

Figure 2A:
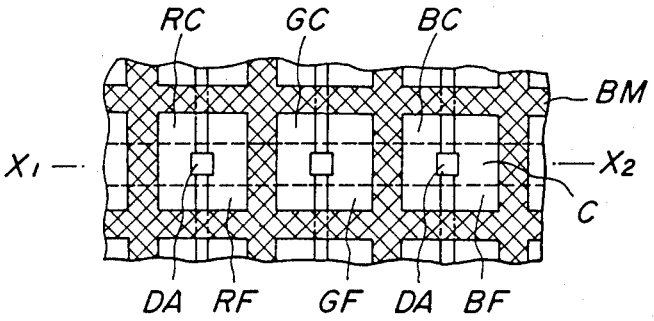
FIG 2a PRIOR ART
FIGS. 2(*a*) and 2(*b*) are a plan view and a cross-sectional view showing the other conventional gas-discharge display device respectively as described above.
Figure 2B:
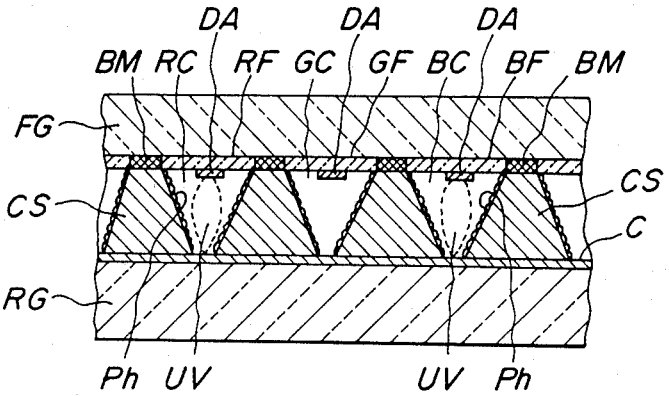
FIG 2b PRIOR ART
Figure 11:
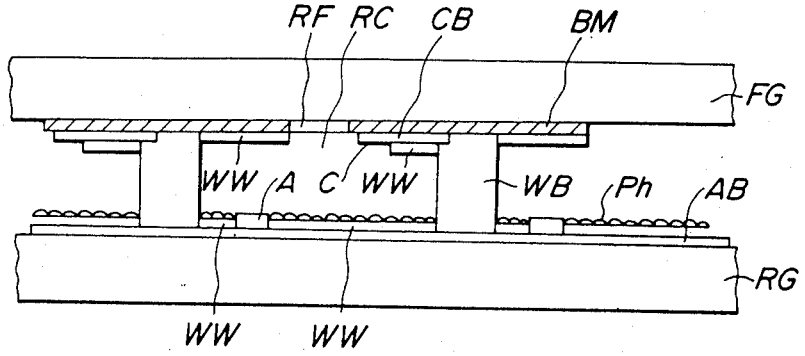
FIGS. 11 to 14 are cross-sectional views showing various embodiments of other kinds of the gas discharge display device according to the present invention respectively.

In the situation where the embodiment of the gas-discharge display device as shown in FIGS. 10(*a*), 10(*b*) is provided for the colored display consisting of single colored light, for instance, red, green or blue light, or, of plural kinds of colored lights, the openings OP of the individual discharge cells are preferably covered with the optical filters provided for the respective colored lights, for example, those mentioned above namely, the optical filters RF, GF and BF made of inorganic materials provided for red, green and blue light respectively. According to the multiplexed effect of the application of the optical filters, the reflectance of the incident ambient light toward the front view side is further reduced. FIG. 11 shows a cross-sectional view of an exemplified embodiment in which a discharge cell for emitting the red light only is shown, so that, in order to realize the tri-colored display, it is sufficient to arrange in order three kinds of similar discharge cells for emitting tri-colored lights respectively as shown in FIGS. 2(*a*), 2(*b*).

Figure 12:
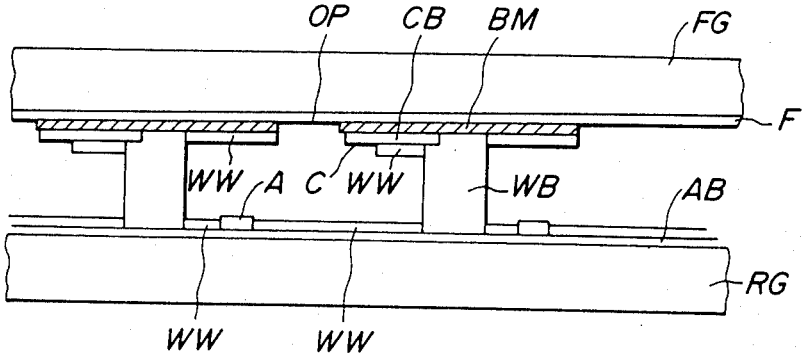

Next, FIG. 12 shows another embodiment of the discharge light direct view type gas-discharge display device of this kind. In this embodiment, the fluorescent layer is not required and hence monochromatic display is effected. Thus, the aforesaid optical filter is preferably applied not only on the opening OP, but also on almost all area of the front glass plate FG for the allotted single colored light. In this connection, it is possible to give the front glass plate FG itself the performance of the optical filter of this kind.

The above described embodiments of the display device according to the present invention can be similarly realized substantially as for all kinds of gas-discharge display devices. Particularly, as for gas-discharge display device provided with the narrow area discharge electrodes, efficient results can be obtained, since the inner absorption of emitted light is reduced. In this connection, the above effects of the present invention can be naturally attained regardless of the difference of the type of gas-discharge between the DC type and the AC type, as well as regardless of the coating position of the fluorescent layer.

Figure 13:
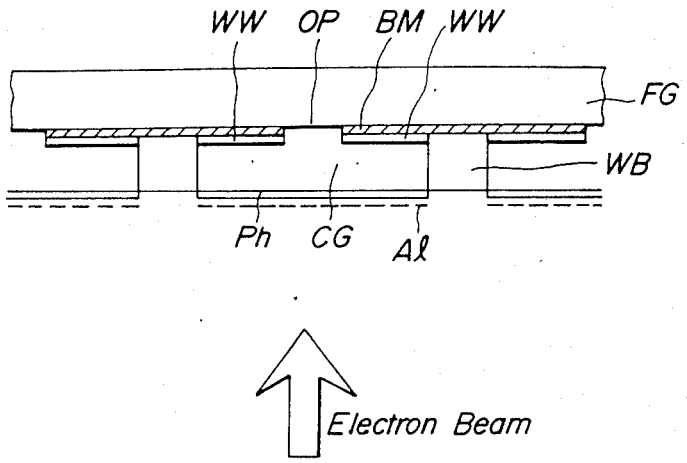

Next, FIG. 13 shows an embodiment of the cathode ray tube display device applied with the present invention, in which enlarged presentation is effected as for one element within the display panel thereof. In this one element separated from adjacent elements by white banks WB, a transparent cell glass CG is provided with a fluorescent layer Ph backed with an aluminum back AL on the rear surface thereof. The front surface of glass CG is provided with a white wall material layer WW backed with a black material layer BM together with the central opening OP. In this embodiment, the light emitted from the fluorescent layer Ph excited by the scanning electron beam is passed through the opening OP toward the front view side as in the discharge cell of the gas-discharge display device, except that the inner space of the display element is filled with the transparent glass material. The reflectance inside the display element can be further increased by providing filter characteristic at least to the opening portion OP of the cell glass CG.

In addition, the present invention can be applied a display device utilizing a low velocity electron beam as described above, and can be applied to other kinds of display devices employing other kinds of light emitting elements including electroluminescent (EL) elements.

Particularly, the structure of the display element as shown in FIG. 13 can be used for the other kinds of display devices. In this connection, in the situation where the light emitting element concerned is formed of a solid body such as an electrical bulb, the portion thereof corresponding to the portion CG as shown in FIG. 13 may be formed of a transparent material such as air, gas and plastics.

Also, it is effective for the non-reflection coating or the non-glare treatment to be additionally employed together with the above described structure to counteract exact reflection.

Figure 14:
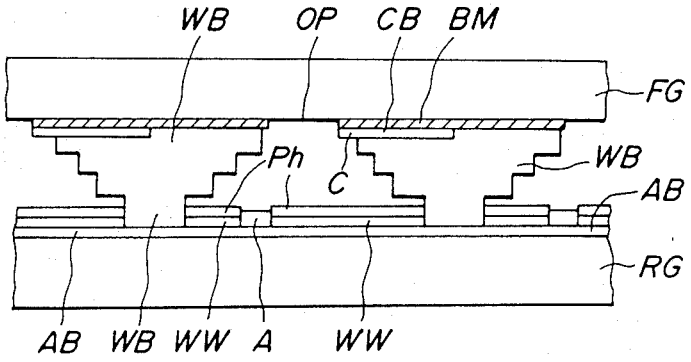

Finally, FIG. 14 shows an embodiment of the display element in which the white bank WB provided for separating adjacent elements is shaped so that the corners thereof are made round, so as to reduce the light quantity lost at those corners. In this situation, it is required that the laminated layers of the round white bank WB be successively stacked on the inner surface of the front glass plate FC employed as for the substrate shown in FIG. 14. In addition, when the rear end portion of the white bank WB is formed similarly as the front end portion thereof as described above, so as to shape the inner space of the display element as a sphere, the light quantity lost at the corner portions is further reduced, so as to realize operation similar to that of an optical integrating sphere with increased efficiency.

The light emitting element employed for the display device according to the present invention can be provided not only with a single opening, but also with plural openings, since the reflectance thereof can be sufficiently reduced, as long as the total area of these plural openings is not large. Further, in a display element provided with plural openings, the distance between displaying light dots is equivalently reduced, so that the dot interference conventionally caused in the displayed picture can be favorably reduced. In this connection, the position of these openings is not restricted to the central portion thereof, but also these plural openings can be arranged in the corner portions of the display element.

Next, the manufacturing materials and the manufacturing procedure of the aforesaid various embodiments provided for attaining the subsidiary object of the invention will be described hereinafter as for an example as shown in FIG. 10.

Black glass paste used for forming the black light-absorbing material BM is printed on the inner surface of the front glass plate FG and fired. Thereafter, a material suitable for forming the cathode C and the cathode bus CB, for instance, Ni-paste is printed on the above black material layer BM and fired. Further thereafter, the white wall material WW and the white bank material WB are printed thereon and fired. As for these white glass materials WW and WB, the same materials as those used for the embodiment provided for attaining the principal object of the invention as shown in FIGS. 3(*a*), 3(*b*) are favorably available.

Also, a material suitable for forming the anode A and the anode bus AB, for instance, Ni-paste is printed on the inner surface of the rear glass plate RG and fired. Thereafter, the white wall material WW is printed on the above material and fired, the fluorescent layer Ph being printed further thereon and fired.

The above described manufacturing process is principally effected by the printing. However, any other suitably selected manufacturing method, for instance, the adhesion methods including deposition and spattering in combination with photoetching can be naturally employed under the application of respectively suitable materials.

In this connection, the white wall material WW and white bank material WB employed for the application onto the cathode ray tube display device are not restricted to glass material other insulation materials and further electrically conductive materials, for instance, metals including Ag, Al, which have sufficiently enough high reflectance for the white wall WW, can also be used.

As is apparent from the above described, according to the present invention, the luminous efficiency of the display device can be increased substantially by 50% in comparison with that of the conventional devices. Particularly, in the situation where the inner white reflector and the optical filter made of inorganic material are employed in common, the contrast of the display can be remarkably increased on account of the sufficient suppression of the reflection of incident ambient light. Moreover, the light emitted from the fluorescent layer in the rear direction can be efficiently reflected by the inner white reflector toward the front view side, so that the same light quantity can be emitted with less fluorescent material.

In addition, the present invention can be favorably applied onto a monochromatic display directly utilizing the colored light emitted, for instance, from an neon gas-discharge together with the optical filter for the colored light concerned.

On the other hand, a remarkably high display contrast can be realized also in the display device according to the present invention, since the low reflectance for the incident ambient light can be obtained by the light absorbing black material coated on almost all front surface other than the opening areas for emitting the light. Moreover, this reflectance can be further reduced through the multiplexed effect obtained by a application of the color filter onto the opening for the colored light concerned, so that the contrast of display can be further increased.

These evident effects of the present invention can be universally obtained as for various kinds of display devices similarly as described earlier.

What is claimed is:

1. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder.

2. A display device as claimed in claim 1, wherein said display device is a gas-discharge display device.

3. A display device as claimed in claim 1, wherein each of said light-emitting elements comprises at least one optical filter made of inorganic material for passing a colored light allotted to said light-emitting element concerned.

4. A display device as claimed in claim 3, wherein each of said light-emitting elements comprises a combination of said optical filter and a black mask provided with an opening which has an area corresponding to a light quantity to be displayed.

5. A display device as claimed in claim 2, wherein a fluorescent layer is arranged on said light-reflecting white layer.

6. A display device as claimed in claim 1, wherein said plurality of light-emitting elements are separated from each other by a white bank formed of said glassy material.

7. A display device as claimed in claim 6, wherein a front end portion of said white bank is covered with black material.

8. A display device as claimed in claim 1, wherein a layer of inorganic material for passing a colored light allotted to said light-emitting element concerned is arranged on said light-reflecting white layer.

9. A display device as claimed in claim 1, wherein a light-absorbing material layer is arranged in front of each of said light-emitting elements except for a vicinity of an opening of said light-emitting element and said light-reflecting white layer is arranged back to back with said light-absorbing layer.

10. A display device as claimed in claim 9, wherein each of said light-emitting elements comprises at least one optical filter made of inorganic material for passing a colored light allotted to said light-emitting element concerned.

11. A display device as claimed in claim 9, wherein a side wall surface formed of a white bank for separating said light-emitting elements from each other is round.

12. A display device as recited in claim 1 wherein said display is an electron beam display device.

13. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder, wherein said glassy material is glazed onto a glass substrate at a temperature below 700° C.

14. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing at most 0.1% by weight of black pigment and 5 to 80% by weight of at least one transparent material having a refractive index other than that of said glass powder, wherein said black pigment belongs to a group consisting of iron oxide, chromium oxide, copper oxide, manganese dioxide, nickel oxide and cobalt oxide.

15. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder, wherein a filling material including said transparent material for filling said glassy material has heat resistivity at least at 700° C.

16. A display device including a plurality of light-emitting elements arranged in a matrix plane, each of said light-emitting elements comprising:

an envelope;

a light emitting member, with said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder, wherein said glassy material is formed by mixing said glass powder 60% by weight which consists of PbO 63% by weight, $SiO_2$ 15% by weight, $B_2O_3$ 17% by weight and ZnO 5% by weight with rutile type titanium oxide 12% by weight and alumina powder 28% by weight.

17. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired in at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder, wherein said glassy material is formed by mixing said glass powder 80% by weight which consists of PbO 63% by weight, $SiO_2$ 15% by weight, $B_2O_3$ 17% by weight and ZnO 5% by weight with rutile type titanium oxide 20% by weight.

18. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder, wherein said glassy material is formed by mixing said glass powder 30% by weight which consists of PbO 77% by weight, $SiO_2$ 2% by weight, $B_2O_3$ 10% by weight, ZnO 7% by weight, $Na_2O_3$ 3% by weight and $Al_2O_3$ 1% by weight with zinc sulfide 70% by weight.

19. A display device including a plurality of light-emitting elements arranged in a matrix plane, each of said light-emitting elements comprising:

an envelope;

a light emitting member, within said envelope;

means for energizing said light-emitting member; and a light-reflecting white member of glassy material coated and fired on at least a portion of an inner wall of said envelope, for reflecting light emitted from said light-emitting member, said light-reflecting white member comprising fired glassy material including at least 20% by weight of a glass powder containing substantially no black pigment and 5 to 80% by weight of at least one transparent material having a refractive index other than that of said glass powder, wherein said glassy material is formed by mixing said glass powder 80% by weight which consists of $Bi_2O_3$ 74% by weight, $B_2O_3$ 9% by weight, ZnO 8% by weight, $SiO_2$ 6% by weight, $Al_2O_3$ 2% by weight and NaO 2% by weight with anatase type titanium oxide 8% by weight and zinc oxide 10% by weight.

* * * * *